US005372017A

United States Patent [19]

Zorea et al.

[11] Patent Number: 5,372,017

[45] Date of Patent: * Dec. 13, 1994

[54] FLUID COOLING SYSTEM

[75] Inventors: Hugo Zorea; Ami Kotler; Uri Tyroler, all of Kfar Szold; Chaim Brody, Rehovot, all of Israel

[73] Assignee: Lordan & Co., Upper Galilee, Israel

[ * ] Notice: The portion of the term of this patent subsequent to Jun. 30, 2009 has been disclaimed.

[21] Appl. No.: 890,011

[22] Filed: May 27, 1992

Related U.S. Application Data

[63] Continuation of Ser. No. 639,243, Jan. 9, 1991, Pat. No. 5,125,243.

[30] Foreign Application Priority Data

Jan. 18, 1990 [IL] Israel ..... 93095

[51] Int. Cl.[5] ..... F25D 3/08

[52] U.S. Cl. ..... 62/457.9; 62/293; 62/504

[58] Field of Search ..... 62/457.9, 244, 293, 62/504, 511, 516, 518, 371, 446

[56] References Cited

U.S. PATENT DOCUMENTS

| | | | |
|---|---|---|---|
| 3,553,976 | 1/1971 | Cummine | 62/457.9 |
| 4,103,510 | 11/1976 | Hall . | |
| 4,342,202 | 6/1980 | Knutson . | |
| 4,711,099 | 12/1987 | Polan et al. | 62/457.9 |
| 5,007,278 | 4/1991 | Maier | 62/457.9 |

FOREIGN PATENT DOCUMENTS

| | | |
|---|---|---|
| 5080285 | 6/1986 | Australia . |
| 2481429 | 10/1981 | France . |
| 3213992 | 10/1983 | Germany . |
| 3740350 | 6/1988 | Germany . |
| 2044424 | 10/1980 | United Kingdom . |
| 2094459 | 9/1982 | United Kingdom . |

*Primary Examiner*—Henry A. Bennet
*Attorney, Agent, or Firm*—Abelman, Frayne & Schwab

[57] ABSTRACT

A system for cooling fluid stored in a generally cylindrical container is disclosed. The system includes a generally cylindrical hollow coil element having an engaged orientation for engaging the container and at least one disengaged orientation in which the container is disengaged. The hollow coil element is configured to provide thermal engagement between a refrigerant fluid located interiorly thereof and the container when the hollow coil element is in the engaged orientation. The hollow coil element includes at least one elongate hollow element with a nonuniform generally spiral configuration, wherein the spiral defines a plurality of turns of the elongate hollow element. There is also disclosed a system for cooling gaseous fluid stored in a selectably disengageable container. The system includes receiving apparatus for selectably receiving the container, cooling apparatus for providing a refrigerant fluid in thermal engagement with the container and apparatus for substantially preventing forceable egress of the gaseous fluid from the container when the container is opened.

12 Claims, 10 Drawing Sheets

FLUID COOLING SYSTEM

This is a continuation of application Ser. No. 639,243 filed on Jan. 9, 1991, now U.S. Pat. No. 5,125,243.

FIELD OF THE INVENTION

The present invention relates in general to refrigeration devices and in particular to devices for cooling fluids.

BACKGROUND OF THE INVENTION

Airconditioning systems for vehicles are well known and are used, particularly in hot climates, fop cooling the interior of a vehicle. It is also known to use an existing vehicle air conditioning system to cool articles of food and drink being carried in a vehicle.

There is described in U.S. Pat. No. 4,103,510 a portable cooling chest operatively attachable to an automobile air conditioning system. The system comprises a portable cooling chest having a durable outer shell and an inner liner, each with bottom and side wall members and includes a unitary middle liner arranged in proximity to the bottom and side wall members of the outer shell to define an insulating compartment and in proximity to the bottom and side wall members of the inner liner to define a sealed cavity circumscribing the inner liner and containing eutectic fluid and immersed heat exchange coils. The heat exchange coils, coupled through a quick connect/disconnect means to the refrigerant of an automobile refrigeration system, circulate chilled refrigerant to chill and freeze the eutectic fluid within the sealed cavity and cool the interior space of the cooling chest.

A disadvantage of the cooling chest described in the above-mentioned U.S. Patent is that it is bulky and invariably takes up space, for example, in the baggage compartment of a vehicle. In addition, access to the cooling chest is not possible from the interior of the vehicle. Furthermore, as articles placed in the cooling chest are cooled by virtue of the entire interior volume thereof being cooled. This way of cooling is relatively slow and inherently wasteful of energy.

There is described in U.S. Pat. No. 3,858,405 a removably positioned refrigerated chest for motor vehicles. U.S. Pat. No. 4,483,151 describes a car airconditioner with a freezer/refrigerator chamber. U.S. Pat. No. 4,483,151 describes a refrigeration system having two evaporators, one of which provides general air conditioning and the other being provided for cooling a cooling chamber. As in U.S. Pat. No. 4,103,510, cooling apparatus employing a cooling chamber or the like is inherently slow and wasteful of energy.

U.S. Pat. No. 3,912,475 describes a combined air conditioner, beverage cooler and engine efficiency booster. The beverage cooler comprises a pair of beverage cooling coils associated with a gasoline engine with a fuel intake providing a source of reduced pressure.

A particular disadvantage to the airconditioner and beverage cooler of the above-referred to patent is that it is not useful with vehicles not having the described fuel intake which provides a source of reduced pressure, nor may it be appended, if so desired, to an existing, conventional vehicle airconditioner.

Disclosed in U.S. Pat. No. 3,553,976 is a container refrigerator which is adapted for attachment to the outside of a container. A refrigerating member is a tubular member, the configuration of which is either that of a C-shaped ring member that can be expanded and snapped onto a cylinder or that of a helically coiled tube that can be expanded and slid onto the container and released to be held in place. The refrigerating member holds a refrigerating medium which can be vented for reduction of temperature and the medium can be expanded between portions of the refrigerating member.

There is also described, in U.S. Pat. No. 4,711,099, a portable quick chilling device for cooling a beverage in a twelve ounce can from about 24 degrees Celsius to about 7 degrees Celsius in approximately four minutes. The evaporator of the device comprises a coil of tubing shaped to receive a generally cylindrical object to be chilled. There is also described apparatus for opening the coil so as to enable insertion of the beverage can thereinto and for closing the coil such that it tightly grips the can.

In U.S. Pat. No. 4,653,289 there is described a vehicle airconditioner ventilator-mounted receptacle for storage and cooling of food, drink or the like. The cooling of the goods contained within the receptacle is provided by circulation therewithin of the cool air flow from the ventilator. A disadvantage of this receptacle is that, as described in the examples, the temperature of goods cooled in the receptacle may be reduced in a relatively long time to a final temperature that is higher than the temperature of the cooled air circulated therearound.

Disclosed in U.S. Pat. No. 2,401,613 is a storage and cooling receptacle for use with a domestic refrigerator.

SUMMARY OF THE INVENTION

It is an aim of the present invention to provide an energy efficient, relatively inexpensive system for rapid cooling of individual standard-sized fluid containers. Preferably, the system is mounted in a vehicle.

There is thus provided in accordance with a preferred embodiment of the present invention a system For cooling fluid stored in a generally cylindrical container, the system including a generally cylindrical hollow coil element having an engaged orientation fop engaging the container and at least one disengaged orientation in which the container is disengaged, the hollow coil element being configured to provide thermal engagement between a refrigerant fluid located interiorly thereof and the container when the hollow coil element is in the engaged orientation, the hollow coil element including at least one elongate hollow element with a nonuniform generally spiral configuration, the spiral defining a plurality of turns of the elongate hollow element.

Further in accordance with a preferred embodiment of the present invention, the hollow coil element is configured such that, when the orientation thereof changes from at least one of the at least one disengaged orientations to the engaged orientation, the turns of the elongate hollow element tighten around the container in a predetermined order.

Still further in accordance with a preferred embodiment of the present invention, the moments of inertia of the cross sections of the hollow element are non-equal.

Additionally in accordance with a preferred embodiment of the present invention, the generally cylindrical configuration includes a substantially conical configuration, thereby defining first and second ends of the hollow coil element, the diameter of the turn at the first end exceeding the diameter of the turn at the second end.

Further in accordance with a preferred embodiment of the present invention, the at least one disengaged orientation includes a first receiving orientation in which the coil element is configured to receive the container and a second at-rest orientation in which the coil element is at rest, and the diameters of the plurality of turns are non-equal at least when the hollow coil element is in the at-rest orientation.

Additionally in accordance with a preferred embodiment of the present invention, the diameter of the cross-section of the container exceeds each of the diameters of the plurality of turns when the hollow coil element is in the at-rest orientation.

Further in accordance with a preferred embodiment of the present invention, the cooling system also includes orientation changing means For selectably changing the orientation of the hollow coil element From a one of the engaged and disengaged orientations to another of the engaged and disengaged orientations.

Further in accordance with a preferred embodiment of the present invention, the orientation changing means includes a spring.

Additionally in accordance with a preferred embodiment of the present invention, the cooling system also includes hollow coil element securing means for securing an end of the hollow coil element, thereby defining a fixed end of the hollow coil element and a free end thereof, and wherein the orientation changing means includes means for rotating the free end about the axis of the generally cylindrical hollow coil element at a relatively high angular velocity.

Still further in accordance with a preferred embodiment of the present invention, the diameter of the turn at the fixed end of the hollow coil element exceeds the diameter of the turn at the free end thereof.

Additionally in accordance with a preferred embodiment of the present invention, the moment of inertia of the cross section of the turn at the fixed end of the hollow coil element exceeds the moment of inertia of the cross section of the turn at the free end thereof.

Still further in accordance with a preferred embodiment of the present invention, the cooling system is characterized in that when the container is placed within the hollow coil element and the free end of the hollow coil element rotates about the axis thereof, the container also rotates about the axis.

Further in accordance with a preferred embodiment of the present invention, the fluid stored in the container includes a gaseous liquid and the cooling system also includes cooling control means for controlling the cooling of the coil, thereby to generally prevent forceable ejection of the liquid from the container when the container is opened.

Additionally in accordance with a preferred embodiment of the present invention, the cooling control means includes temperature control means For sensing and controlling the temperature of the coil.

According to a further preferred embodiment of the present invention there is provided a system for cooling gaseous fluid stored in a selectably disengageable container, the system including receiving means for selectably receiving the container, cooling means for providing a refrigerant fluid in thermal engagement with the container and means for substantially preventing forceable egress of the gaseous fluid from the container when the container is opened.

Further in accordance with a preferred embodiment of the present invention, the cooling means includes a coil through which said refrigerant fluid flows and the means for preventing comprises temperature control means for sensing and controlling the temperature of the coil.

Still further, in accordance with a preferred embodiment of the present invention, the temperature control means maintain the temperature of the coil generally above −7 degrees Celsius. Alternatively, the temperature control means are operative to cease the operation of the cooling means when the temperature of the coil drops below generally −7 degrees Celsius and renew the operation of the cooling means when the temperature rises generally above +1 degree Celsius.

BRIEF DESCRIPTION OF THE DRAWINGS

The present invention will be understood and appreciated more fully from the following detailed description taken in conjunction with the drawings, in which.

DETAILED DESCRIPTION OF THE INVENTION

Figure 1A:
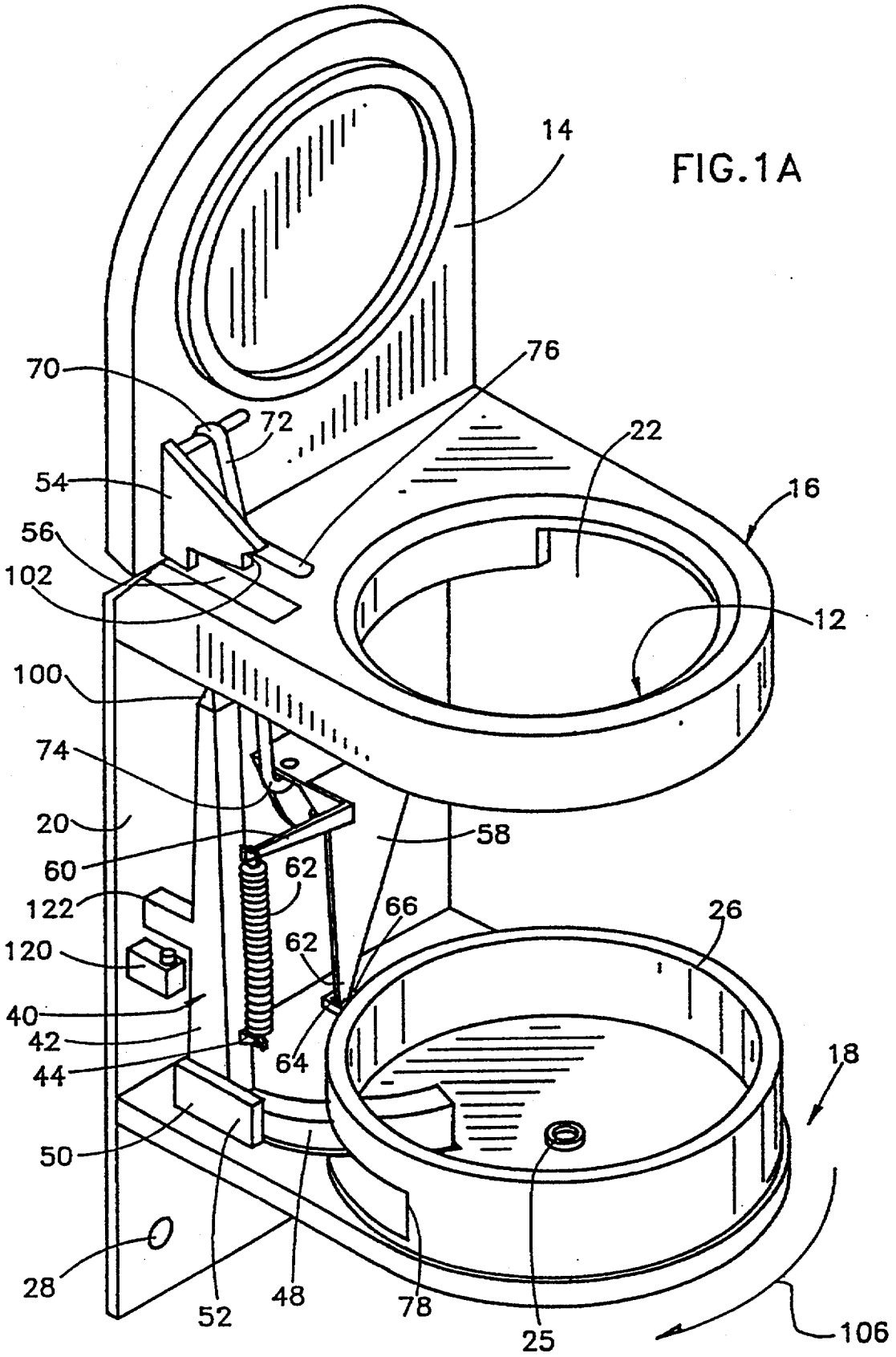
FIG. 1A is an illustration of beverage cooling apparatus constructive and operative in accordance with a preferred embodiment of the present invention, in an open orientation prior to insertion of a beverage container.
Figure 1B:
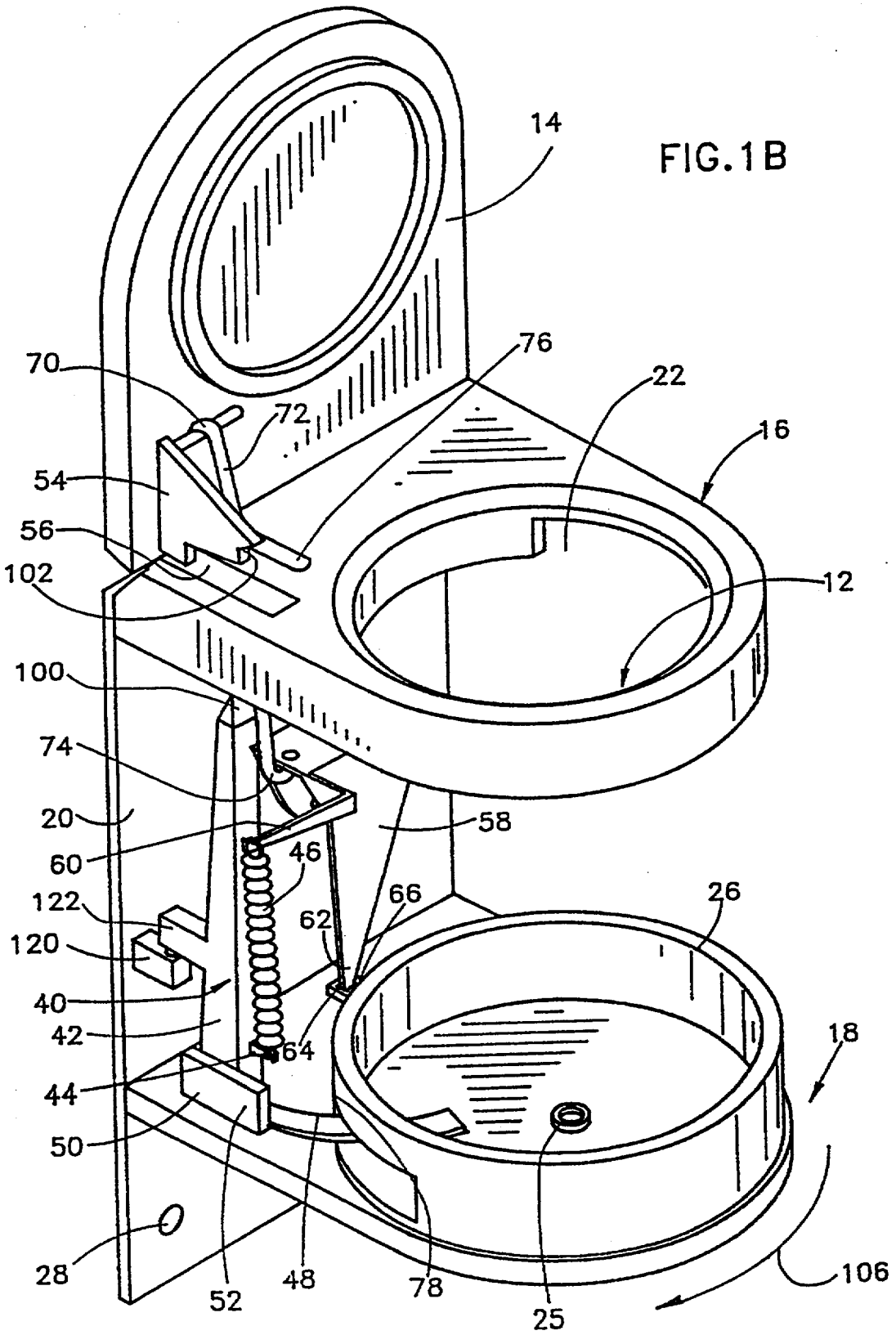
FIG. 1B is an illustration of the beverage cooling apparatus of FIG. 1A, in a first open orientation following insertion of a beverage container.

Reference is now made to FIGS. 1A–4, which illustrate beverage cooling apparatus, referenced generally 10, being constructive and operative in accordance with a preferred embodiment of the present invention and having a first open orientation and a second closed orientation. The apparatus defines a generally cylindrical beverage container receiving volume 12. The apparatus comprises a cover 14, a top support portion 16 to which the cover 14 is hingeably attached, a bottom support portion 18, and a generally planar vertical support portion Top support 16 is generally planar and has a circular aperture 22 formed therethrough, through which the container is inserted.

Bottom support portion 18 comprises a horizontal generally planar base to which is rotatably attached, as by means of a bolt 25, generally cylindrical container receiving means 26.

Vertical support 20 typically comprises means for attaching the apparatus 10 to a vehicle, such as apertures 28 through which screws may be passed. Vertical support 20 also typically comprises apertures (not shown) through which electrical connections to the cooling controls shown and described hereinbelow may pass.

Figure 2A:
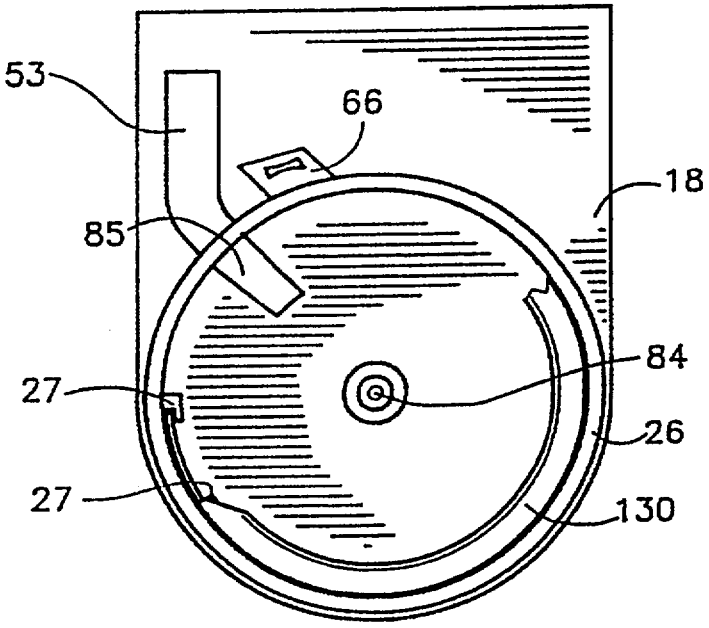
FIG. 2A is a top sectional illustration of the bottom portion of the beverage cooling apparatus of FIGS. 1A–C, when in either one of the open orientations of FIG. 1A and FIG. 1B.
Figure 2B:
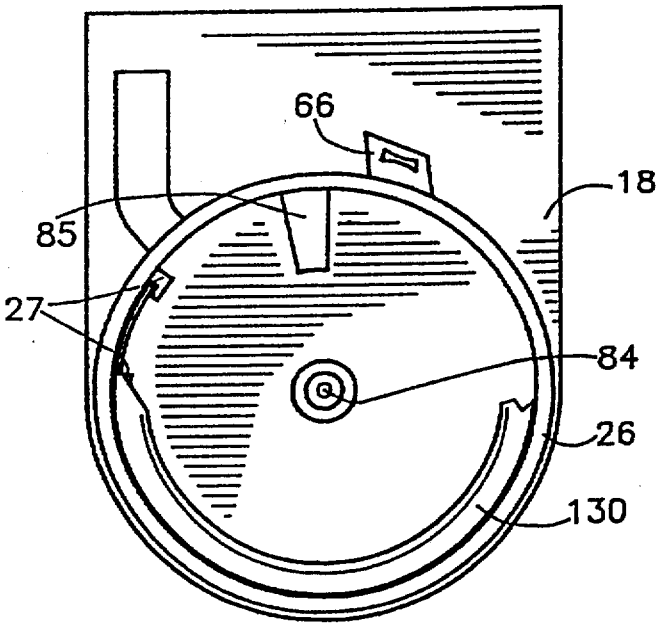
FIG. 2B is a top sectional illustration of the bottom portion of the beverage cooling apparatus of FIGS. 1A–1C, when in the closed orientation of FIG. 1C.

There is also provided a hollow spiral coil 130 (shown in FIGS. 5A and 5B), through which refrigerating fluid may flow, surrounding the container receiving volume 12. A first fixed end of the coil is secured to the top support portion 16 and a second rotating end of the coil is fixedly attached to the container receiving means 26 (preferably at two attachment locations 27, as best seen in FIGS. 2A–2B) such that the rotating end of the coil and the container receiving means 26 rotate together.

In accordance with a preferred embodiment of the present invention, coil 130 is operative to cool a beverage container with which it comes into contact. In an at-rest state, the inner diameter of coil 130 is less than that of a standard beverage container. Therefore, to insert a beverage container into coil 130, coil 130 has to be twisted open into an open orientation. The beverage cooling apparatus 10 is operative to open coil 130 to enable the insertion of the beverage container and to enable coil 130 to close around the beverage container so as to provide close contact between the coil 130 and the container, as described in detail hereinbelow.

There is also provided a first generally elongate element 40, comprising a generally upright elongate portion 42, a spring engaging portion 44 engaging a first end of a spring 46, and a container elevating portion 48. Generally elongate element 40 is pivotably and slidably mounted at a mounting location 50, such that it can pivot toward and away from the plane defined by vertical support and such that it can slide down into a guiding track 52, typically integrally formed with the bottom support portion 18 and associated with an opening 53 in the floor of bottom support portion 18 and configured and arranged to mate with container elevating portion 48.

The downward sliding movement of generally elongate element 40 is controlled by a protrusion 54 which extends generally perpendicularly to the plane defined by the cover 14 and which enters a protrusion receiving opening 56 provided in the top support portion 16. Protrusion 54 is preferably integrally formed with the cover 14.

There is further provided a second generally elongate element 58 comprising a spring engaging portion 60 for engaging a second end of the spring 46 and a cup engaging portion 62 for engaging the container receiving means 26, typically via an aperture 64 in a protruding portion 66. Protrusion 66 protrudes outwardly from and is preferably integrally formed with the container receiving means 26. Second generally elongate element 58 is pivotably joined to vertical support 20, as by a screw and bolt arrangement (not shown).

There is also provided a cover engaging element 70 which is pivotably mounted, at a first end thereof, to the cover 14 as by being bent around an elongate element 72 fixedly attached to the cover 14. The cover engaging element pivots about the axis defined by elongate element 72 when the cover is opened or closed. At a second end 74 thereof, the cover engaging element 70 engages the second generally elongate element 58. The cover engaging element 70 passes through an opening 76 provided in top support portion 16.

Figure 3A:
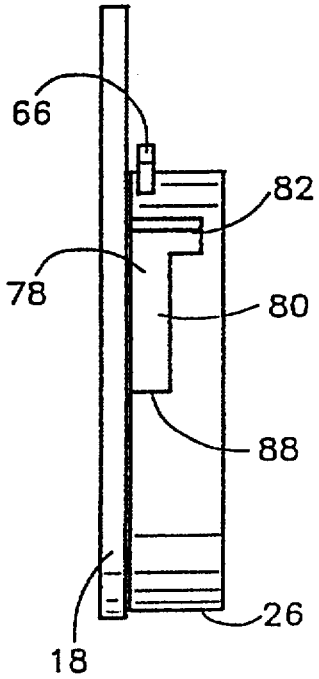
FIG. 3A is a side sectional illustration of the bottom portion of the beverage cooling apparatus of FIGS. 1A–1C, when in either one of the open orientations of FIG. 1A and FIG. 1B.
Figure 3B:
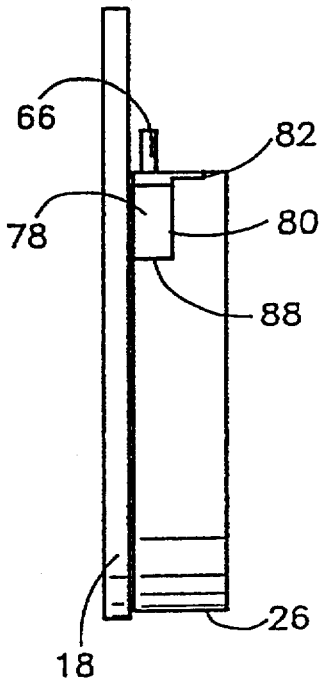
FIG. 3B is a side sectional illustration of a portion of the beverage cooling apparatus of FIGS. 1A–1C, when in the closed orientation of FIG. 1C.

Container receiving means 26 is formed with an L-shaped aperture 78 in the wall thereof, best seen in FIGS. 3A and 3B, the longer arm 80 of which is generally circumferentially arranged and contacts the floor of container receiving means 26, and the shorter arm 82 of which is generally axially arranged with respect to an axis 84 (FIGS. 2A–2B) of the cylindrical volume 12. An opening 85 in the floor of container receiving means 26 is arranged generally opposite the shorter arm 82. The aperture 78 is arranged relative to the container elevating portion 48 such that, when the cover is opened, the container elevating portion 48 slides along long arm 80 of the aperture and toward short arm 82, and then up short arm 82. A stopper (not shown), typically integrally formed with the bottom support portion 18, is arranged to contact the tip 88 of the long arm 80.

The mechanical operation of the apparatus 10 will now be described. Assuming the apparatus is in the open orientation of FIG. 1A, a beverage container (not shown) is inserted by a user of the apparatus through aperture 22 and is pushed downwards by the user, through coil 130 (not shown), pushing down container elevating portion 48 until the container is fully seated within container receiving means 26. In this position, shown in FIGS. 1B and 2A, the container receiving means opening 85 and the bottom support portion opening 53 are arranged one opposite the other.

In response to the movement of the beverage container, container elevating portion 48 slides down arm 82 of aperture 78, descends through both openings and protrudes somewhat below bottom support portion 18 and the top tip 100 of the first elongate element 40 is aligned opposite a contacting portion of cover protrusion 54. In this position, portion 48 blocks the movement of container receiving means 26.

Figure 4:
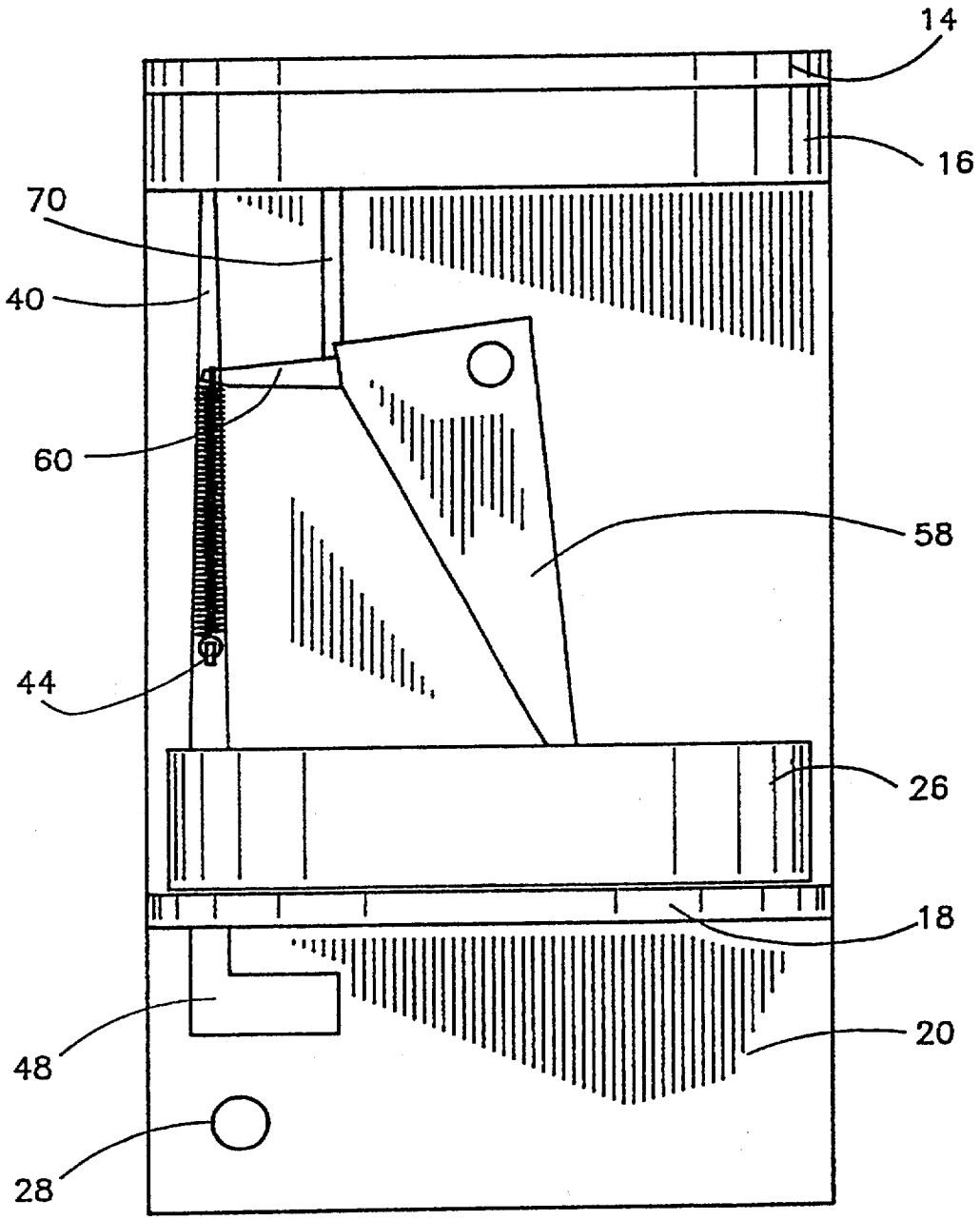
FIG. 4 is a front view illustration of the beverage cooling apparatus of FIGS. 1A–1C, when in the closed orientation of FIG. 1C.

The cover 14 is then closed by the user of the apparatus. The cover engaging element 70 releases the second elongate element 58. The cover protrusion 54 descends along a path generally perpendicular to the plane of the cover 14 and urges the first elongate element 40 further downward into its track 52. Portion 48 of elongate element 40 is forced thereby from its rotation blocking engagement with the floor of container receiving means 26 to a position below container receiving means 26 (FIG. 4). This happens a relatively short time before the cover 14 fully closes onto top support portion 16 and enables the container receiving means 26 to rotate freely and quickly until tip 88 of long arm 80 reaches the stopper (not shown). This rotation causes "snap" rotation of the coil 130, i.e. rotation of a relatively short duration and at a relatively high velocity.

Due to the coil's tendency to assume its at-rest state, in which its diameter is less than that of the container, the rotating end of the coil and the container receiving means 26 which is engaged therewith, and is now free to rotate, then rotate in the direction of the arrow 106 at a relatively high angular velocity over a short distance. As a result, the coil-container engagement rapidly tightens until at a certain point (when the bottom turn of the coil engages the container sufficiently tightly), the container begins rotating in the same direction as the rotating end of the coil, thereby enhancing the inertia of the rotation. When the rotation ceases, the coil-beverage container engagement is very tight, thereby enhancing efficient cooling of the beverage by the coil. The spring 46 acts to maintain the tightness of the engagement since relaxation of the engagement (rotation in a direction opposite to arrow 106) results in tensioning of the spring 46 due to the pivoting of elongate element 58.

A further advantage of the tight coil-beverage container engagement provided by the above structure is that it, since there is generally good contact between the coil and the container, the temperature of the coil is an approximate but relatively accurate indication of the temperature of the container. This enables the indication of the temperature of the container to be obtained, without tampering with the container, via sensing the temperature of the coil as shown and described hereinbelow.

Figure 1C:
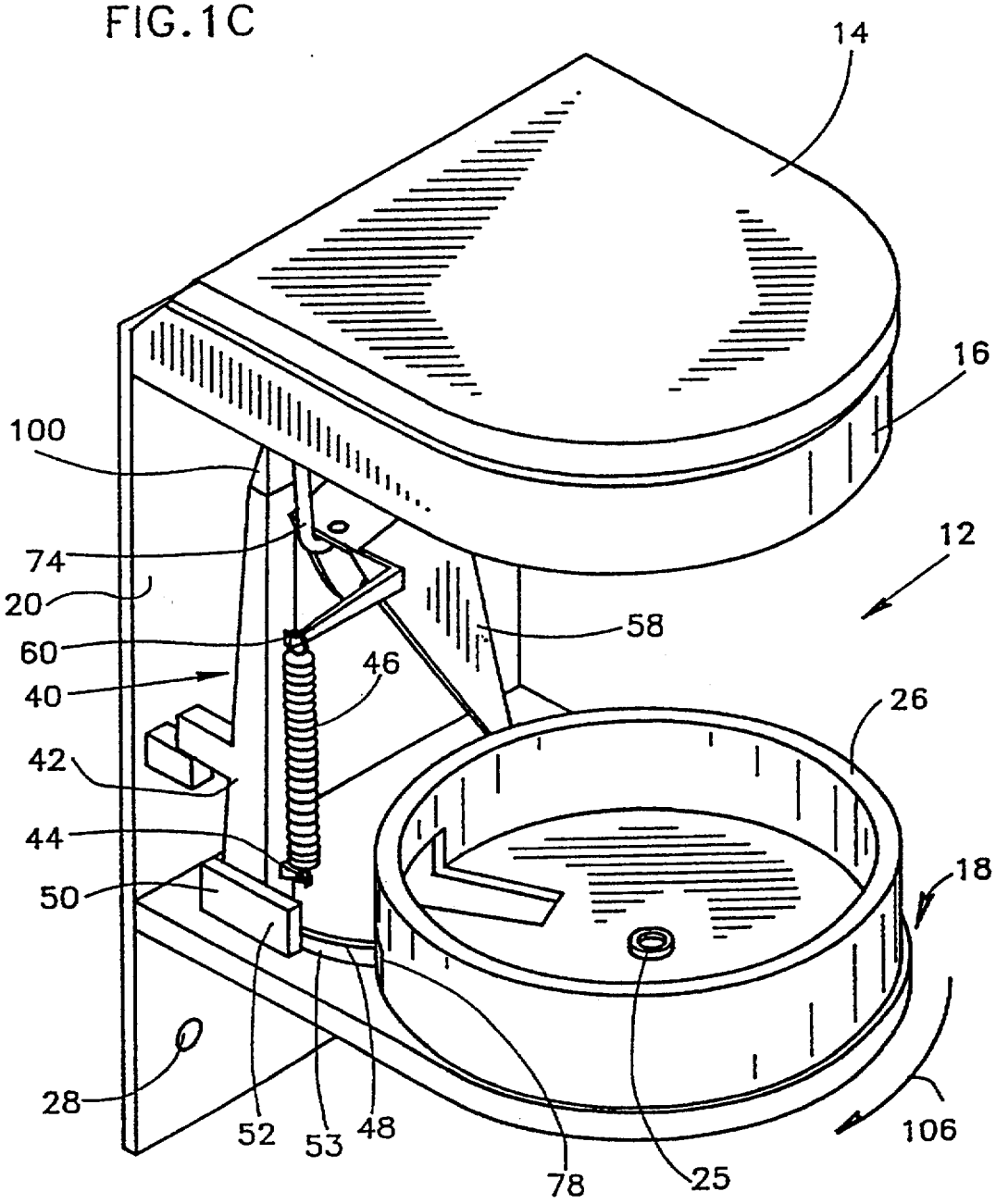
FIG. 1C is an illustration of the beverage cooling apparatus of FIG. 1A, in a closed orientation following insertion of a beverage container.

The closed orientation of the apparatus is shown in FIG. 1C. When desired (or in response to a suitable signal indicating that the cooling process has been terminated), the user opens the cover 14. The cover engaging element 70 urges the second elongate element 58 to pivot back to its original position. Second elongate element 58 urges the container receiving means 26 and consequently the rotating end of the coil to rotate in the opposite direction to the arrow 106. The second elongate element 58 also tensions the spring 46, which urges the first elongate element 40 back upwards to its original position. The container elevating portion 48 of element 40 causes elevation of the can so that, when the cover 14 is fully open, the user can easily remove the beverage container from the cylindrical volume 12.

The hollow spiral coil element 130 through which refrigerating fluid may flow has a generally nonuniform configuration, which has the advantage of causing the turns of the coil to tighten around the can in a predetermined order.

The cooling apparatus shown and described herein may be actuated in any desired manner. According to a preferred embodiment, there is provided a switch 120 on the support board 20 of the device which is automatically actuated by a protrusion 122 formed on elongate element 40, the protrusion being configured and arranged to contact the switch 120 and transfer it to its "on" position only when the cover 14 has been closed and a container is positioned within the container receiving means 26.

Figure 5A:
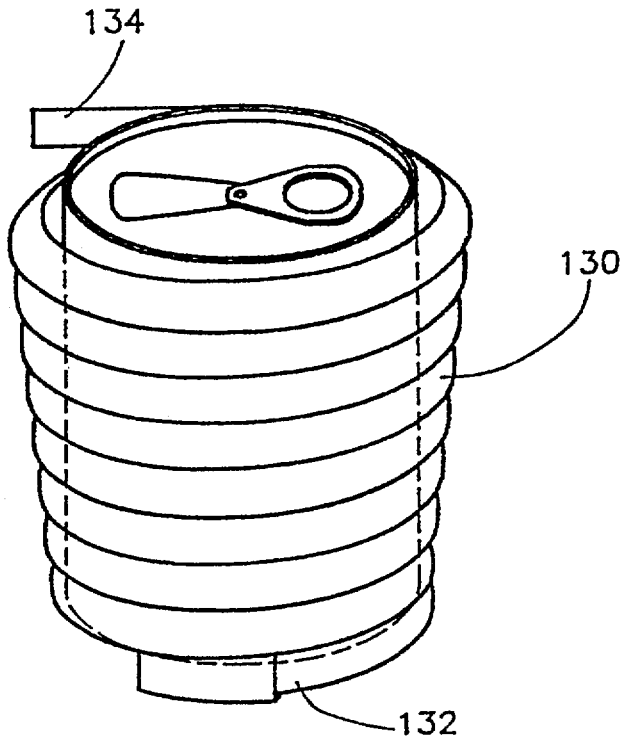
FIG. 5A is a side view illustration (not to scale) of the coil of the beverage cooling apparatus of FIGS. 1A–1C, when in the first open orientation of FIG. 1B.
Figure 5B:
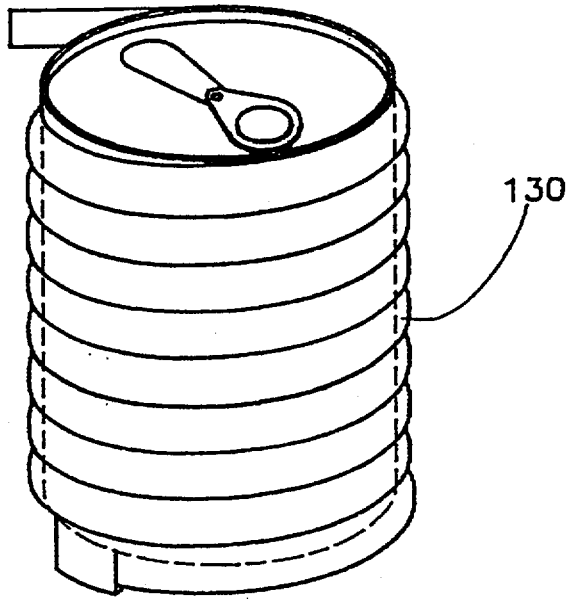
FIG. 5B is a side view illustration (not to scale) of the coil of the beverage cooling apparatus of FIGS. 1A–1C, when in the closed orientation of FIG. 1C.

FIGS. 5A and 5B illustrate a first preferred configuration of the hollow spiral coil element 130 in which the spiral coil element 130 is configured such that, at least when no beverage container is engaged therewith, the inner diameters of the turns thereof are non-equal, as seen best in FIG. 5A. A preferred configuration is a truncated conical configuration. It is preferred that, as shown in FIG. 5A, the diameters of the turns gradually increase when proceeding from a rotating end 132 of the spiral coil element to a fixed end 134 thereof. If this configuration is employed, the extreme turn at the rotating end will tighten first, urging the container to rotate, and the turns proceeding from the rotating end to the fixed end will then tighten one at a time. An alternative configuration is an "hourglass" configuration in which the diameters of the turns are greatest at both ends of the coil element and are smallest at the middle of the coil element, in which case the tightening process will begin in the middle of the coil and spread to both ends thereof. Either of these configurations will result in a tight engagement of the coil element 130 with a beverage container and will prevent a situation wherein first and second non-adjacent turns of the coil element tightly engage the container and the turns between the first and second tightly engaged turns are only loosely engaged with the container.

It is noted that when the beverage cooling device is constructed as shown and described hereinabove, i.e. wherein the diameter of the coil at the rotating end thereof is relatively small and increases generally uniformly toward the fixed end of the coil, then almost for the entire time of rotation, the beverage container as well as the rotating end 132 of the hollow coil element 130 is rotated about the axis of the hollow coil element. This construction has the advantage of further tightening the final engagement between the container and the coil element, relative to an alternative construction in which the beverage container does not rotate but rather remains stationary. This is due to the fact that the frictional engagement between the container and the turn that is tightening around the coil at a given moment increases the tension of the portion of the coil defined by the turn. This increase urges the container and the free end of the coil to rotate further, which in turn further increases the frictional forces, causing further tensioning, and so on, until the coil reaches its maximally tensioned state.

A further advantage of the above construction is that the container and the rotating end of the hollow coil element are caused to rotate at a relatively high angular velocity due to the "snap" mechanism which goes into effect when the cover of the device is closed by a user. This acts to increase the inertia of the rotating elements (particularly of the beverage container due to the relatively large mass thereof), resulting in a further tightening of the final engagement between the container and the coil element relative to an alternative construction in which the angular velocity is smaller, due to the impact created by the rotating elements when rotation is terminated due to the coil having reached its maximally tensioned state.

Figure 9:
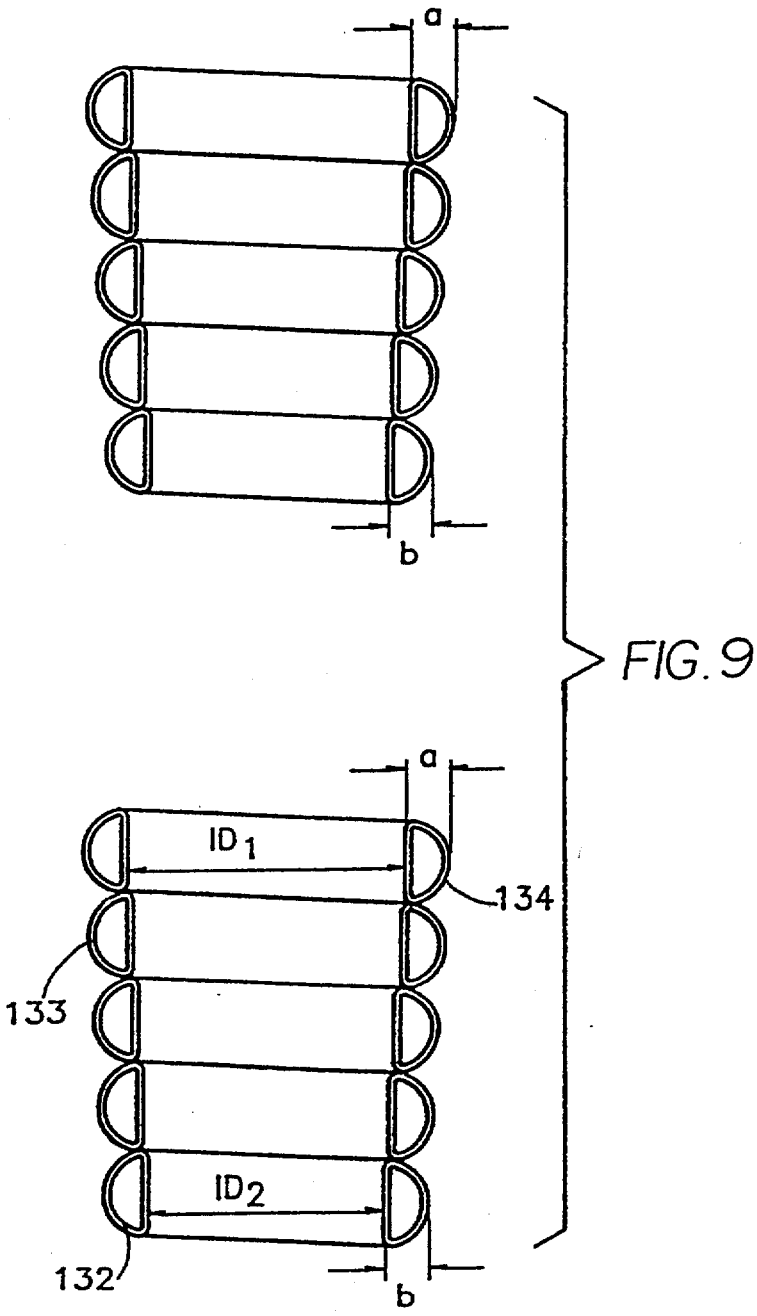
FIG. 9 is a cross sectional illustration (not to scale) of the coil of the beverage cooling apparatus of FIGS. 1A–1C, constructed and operative in accordance with a preferred embodiment of the present invention.

FIG. 9 illustrates the truncated conical configuration of coil 130 wherein the inner diameter $ID_1$ at the fixed end 134 is larger than the inner diameter $ID_2$ at the rotating end 132. In FIG. 9, the moments of inertia of the cross sections of the hollow element defining the coil are shown to increase as one proceeds from the fixed end of the coil to the rotating end thereof. The width of the cross section at the fixed end 134 may be approximately b=4.8 mm and the width of the cross section at the rotating end 132 may be approximately a=5 mm, as shown. This configuration enables a truncated conical configuration wherein the inner walls 133 of each coil remains vertical and also results in tightening occurring starting from the rotating end 132 and proceeding toward the fixed end 134. It is appreciated that the moments of inertia of the cross sections of the hollow element defining the coil may be varied in any other suitable manner.

Reference is now made to FIGS. 6A–8C which illustrate cooling control systems useful in conjunction with the coil apparatus shown and described hereinabove and constructed and operative in accordance with various preferred embodiments of the present invention. The cooling is provided by the airconditioning system of the vehicle in which the beverage cooling apparatus is installed.

It has been found that due to the fast heat transfer rate between the coil and the beverage container, a cooling temperature of generally less than about −10 degrees Celsius on the coil 130 for a number of minutes generally causes a thin layer of ice to form inside the container. For gaseous liquids, such as carbonated beverages, the layer of ice causes an increase in the pressure in the container such that a forceable ejection of the liquid occurs when the container is opened. Furthermore, for certain beverages, and particularly dietetic beverages, a temperature of below −7 degrees Celsius on the coil for a number of minutes will generally cause the forceable ejection. Therefore, it is desirable to ensure that the temperature on the coil should not fall below −7 degrees Celsius.

In certain vehicles, particularly vehicles manufactured by American companies such as Chevrolet, Oldsmobile, General Motors, etc., the air conditioning system is such that the temperature on a coil installed in such a vehicle will remain above −7 degrees Celsius. These airconditioners are equipped with a CPS (cycling pressure switch) which maintains the pressure at approximately 25–45 psi, which is equivalent to a temperature of approximately −3 to +8 degrees Celsius. However, even in these vehicles it is preferable to provide a thermostat for ensuring that the temperature on the coil does not drop below −7 degrees Celsius since the CPS can sometimes break down.

Figure 6A:
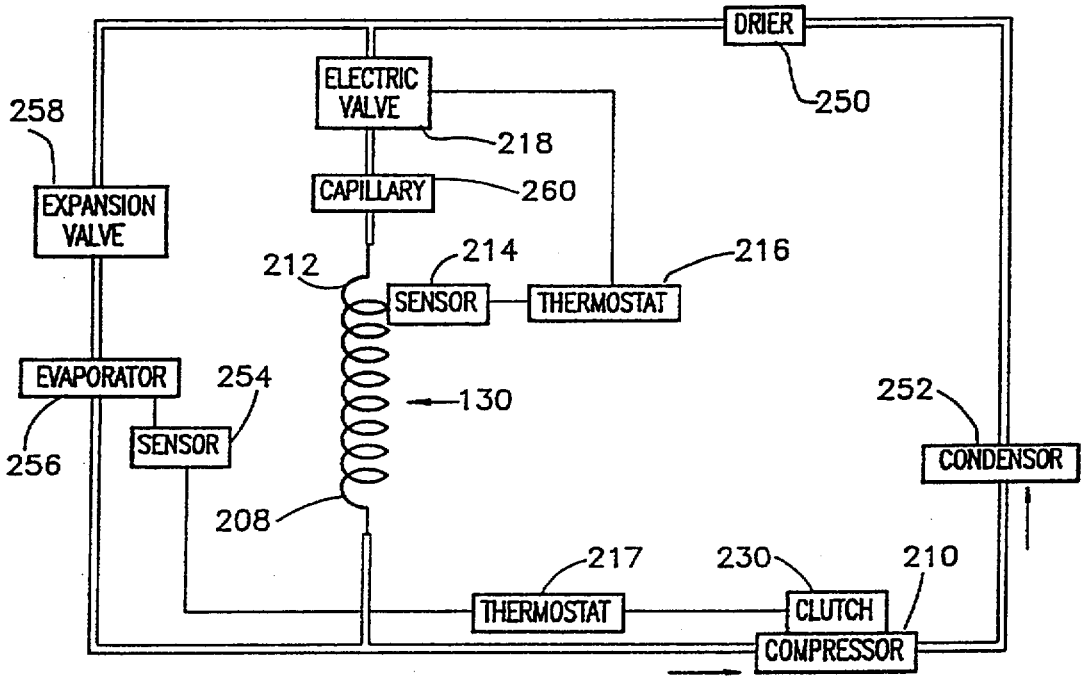
FIG. 6A is a block diagram illustration of a cooling control system constructed and operative in accordance with a first preferred embodiment of the present invention and useful in conjunction with the beverage cooling apparatus of FIGS. 1A–5B.
Figure 6B:
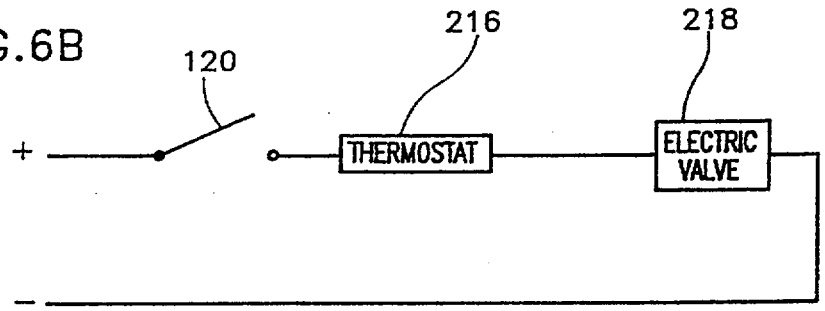
FIG. 6B is a schematic illustration of electronic circuitry useful in implementing the cooling control system of FIG. 6A.

Reference is now made to FIGS. 6A–6B, which illustrate a cooling control system suitable for use in vehicles in which the temperature on the coil does not normally fall below −7 degrees Celsius. In FIG. 6A (and in FIGS. 7A, 8A and 8C), the double lines indicate the flow of refrigerant fluid whereas the single lines indicate associations between the control components.

The airconditioning system of the vehicle normally comprises the following elements interconnected in the standard manner: a drier 250, a condensor 252, a compressor 210 having an associated clutch 230, a thermostat 217 controlling the compressor 210 and having a temperature sensor 254, the sensor 254 being in temperature sensing association with an evaporator 256, and an expansion valve 258. The fluid cooling system of the present invention comprises an additional path for refrigerant fluid located across the drier, condensor and compressor. Along the path there are provided the coil 130, a capillary 260 and an electric valve 218. The coil 130 has a first end 208 and a second end 212, the second end 212 being that connected to the capillary 260. A temperature sensor 214 is provided in temperature sensing association with the end 212 of the coil. It is appreciated that the temperature at end 212 of the coil will generally be lower than or at least as low as the temperature at end 208 of the coil.

Input from the sensor 214 is received by a thermostat 216 which controls the electric valve 218. Valve 218 controls the supply of refrigerating fluid from the compressor 210 to the coil 130. Thermostat 216 is suitably programmed in order to substantially prevent too rigorous cooling of the container and consequent forceable ejection of the beverage from the container when opened. For example, thermostat 216 may be programmed such that cooling of the coil stops when the temperature sensed by sensor 214 drops to −7 degrees Celsius and is renewed when the temperature sensed by the sensor 214 reaches −6 degrees Celsius.

It is noted that the embodiment of FIGS. 6A–6B operates externally of the control components of the airconditioning system and is not intrusive thereinto.

Figure 7A:
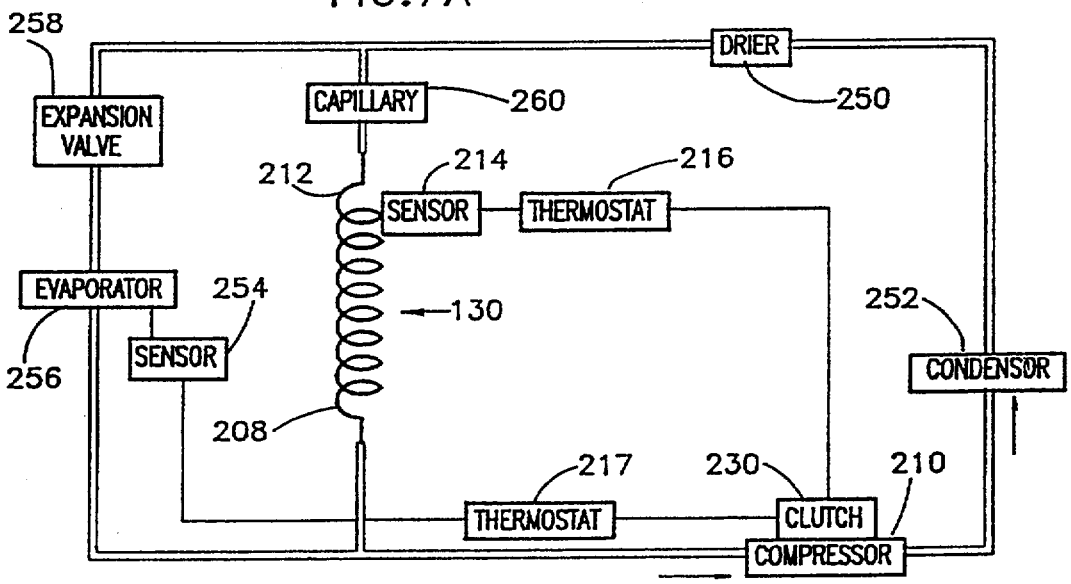
FIG. 7A is a block diagram illustration of a cooling control system constructed and operative in accordance with a second preferred embodiment of the present invention and useful in conjunction with the beverage cooling apparatus of FIGS. 1A–5B.
Figure 7B:
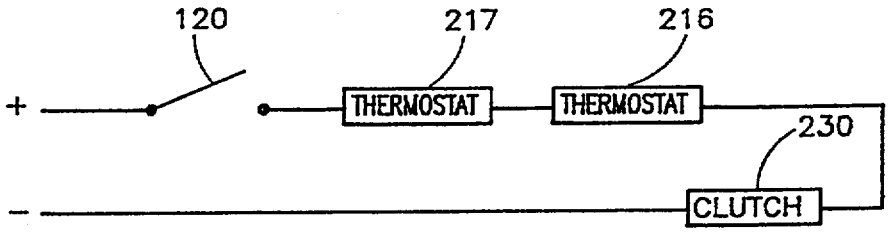
FIG. 7B is a schematic illustration of electronic circuitry useful in implementing the cooling control system of FIG. 7A.
Figure 7C:
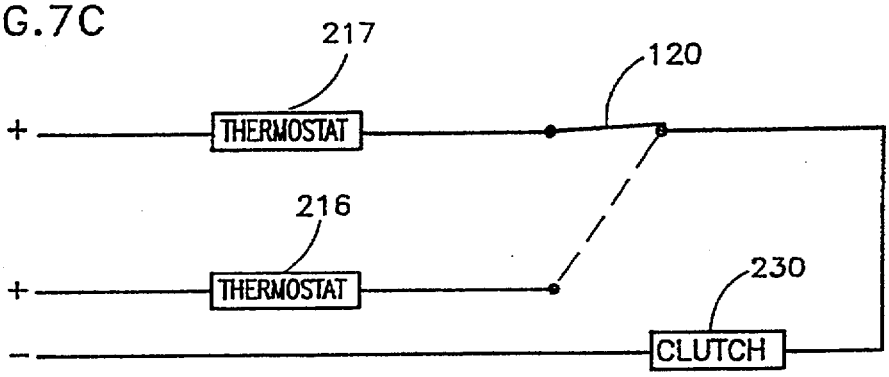
FIG. 7C is a schematic illustration of electronic circuitry useful in an alternative implementation of the cooling control system of FIG. 7A.

Reference is now made to FIGS. 7A–7C, which illustrate a cooling control system suitable for use in vehicles in which the temperature on the coil, in the course of normal operation of the airconditioning system, sometimes falls below −7 degrees Celsius. Identical reference numbers to the reference numbers of FIG. 6A will be used herein to denote elements similar to those of FIG. 6A.

The embodiment of FIG. 7A is generally similar to the embodiment of FIG. 6A. However, no valve 218 is provided and thermostat 216, instead of controlling valve 218, directly controls the clutch 230 of the compressor 210. Thermostat 216 is suitably programmed in order to substantially prevent too rigorous cooling of the container and consequent forceable ejection of the beverage from the container when opened. For example, the thermostat 216 may be programmed such that operation of the compressor is terminated when the temperature sensed by sensor 214 drops to −7 degrees Celsius and is renewed when the temperature sensed by the sensor 214 reaches +1 degrees Celsius.

In FIG. 7B, the thermostat 216 is shown connected in series with the integral thermostat 217 of the vehicle's airconditioning system. In FIG. 7C, the thermostat 216 is connected across the thermostat 217, and the actuating switch 120 is operative to ensure that the vehicle's integral thermostat 217 is rendered inoperative during the operation of the cooling system shown and described herein, the operation of the compressor being entirely controlled by the thermostat 216. This has the advantage of preventing cessation of cooling due to cessation of the operation of the compressor by the thermostat 217.

Figure 8B:
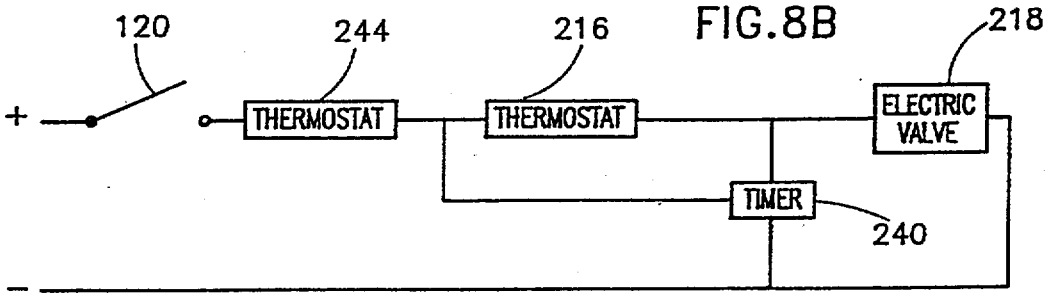
FIG. 8B is a schematic illustration of electronic circuitry useful in implementing the cooling control system of FIG. 8A.
Figure 8A:
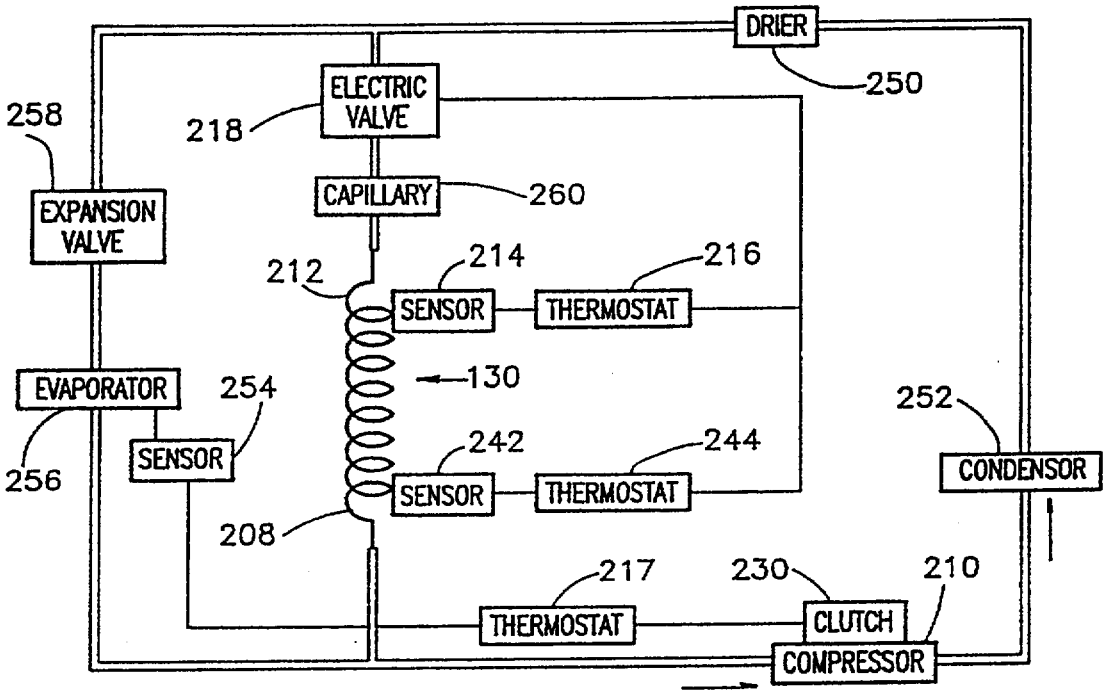
FIG. 8A is a block diagram illustration of a cooling control system constructed and operative in accordance with a third preferred embodiment of the present invention and useful in conjunction with the beverage cooling apparatus of FIGS. 1A–5B.

Reference is now made to FIGS. 8A–8B, which illustrate a cooling control system suitable for use in vehicles in which the temperature on the coil, in the course of normal operation of the airconditioning system, sometimes falls below −7 degrees Celsius. The embodiment illustrated resembles the embodiment of FIGS. 6A–6B except for the following differences: both ends of the coil are connected to thermostats via temperature sensors, instead of only one end of the coil as in FIGS. 6A–6B. As in FIGS. 6A–6B, sensor 214 is in temperature sensing association with end 212 of the coil and the data therefrom is received by thermostat 216. In addition, a sensor 242 is provided in temperature sensing association with end 208 of the coil and the data therefrom is received by a thermostat 244. Thermostats 244 and 216 control the operation of electric valve 218 which controls the flow of refrigerant fluid from the compressor 210 to the coil. Thermostat 244 is operative to ensure that the temperature range sensed by temperature sensor 242 remains within the range of 0 to −7 degrees Celsius, whereas thermostat 216 is operative to ensure that the temperature range sensed by temperature sensor 214 remains within the range of 0 to −18 degrees Celsius: If the low point of either temperature range is sensed, the valve 218 cuts off the flow of refrigerant fluid, renewing it if the high point of either temperature range is sensed.

In FIG. 8B, there is shown an optionally provided timer 240 which gives an indirect indication of the temperature of the fluid in the container. Specifically, the timer 240 counts the time interval in which thermostat 244 is in its disconnected state. If the temperature is found to go from −7 degrees to 0 degrees in a relatively short time period, e.g. within 15 seconds, this indicates that the fluid is insufficiently cool and the cooling process is not terminated. If the temperature is not found to reach 0 degrees within 15 seconds, this indicates that the fluid is cool enough and the cooling process is terminated. Preferably, audio indicating means (not shown) indicates this to the user of the device.

Figure 8C:
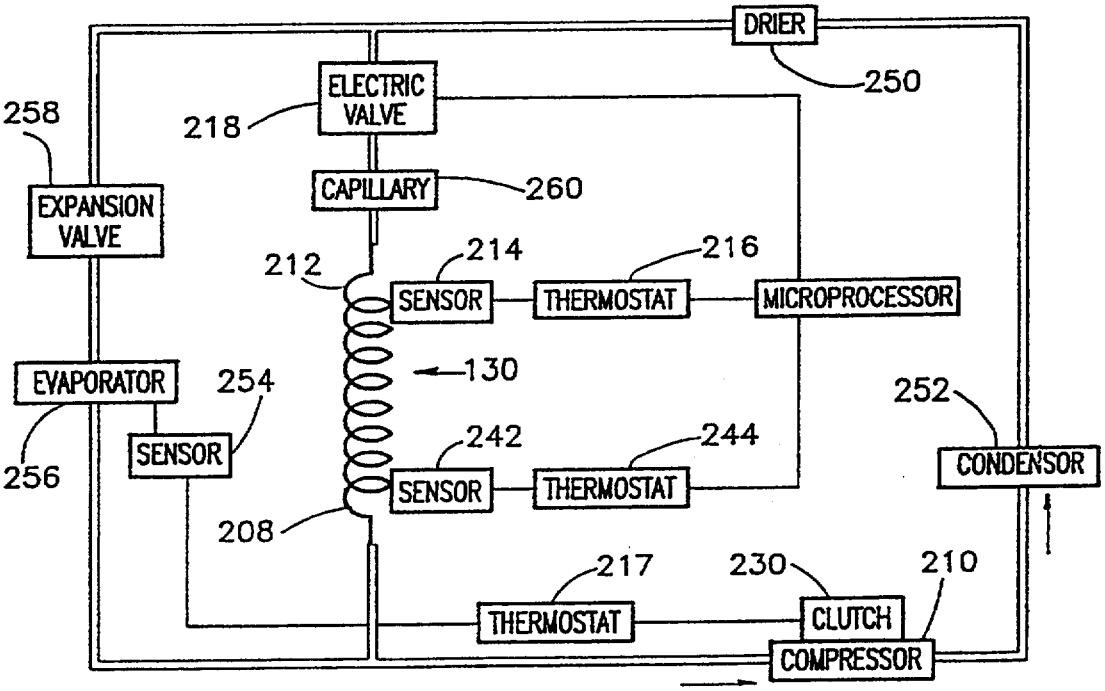
FIG. 8C is a block diagram illustration of a proposed cooling control system which is a variation of the cooling control system of FIG. 8A.

Reference is now made to the embodiment of FIG. 8C, which is a proposed variation of the embodiment of FIG. 8A, being generally similar thereto except that the inputs from sensors 214 and 242 are received by a microprocessor 246, instead of being separately received by thermostats 216 and 244. The microprocessor controls valve 218. Microprocessor 246 is suitably programmed to ensure that the temperatures sensed by thermostats 244 and 216 do not fall below −18 degrees Celsius, by cutting off the flow of refrigerant fluid at that point. Also, microprocessor 246 terminates cooling when the difference of temperature sensed by sensor 242 and by sensor 214 is less than 2 degrees Celsius, or after 8 minutes of cooling have elapsed, whichever of the two time periods is shorter.

It is noted that the embodiments of FIGS. 8A and 8C operate externally to the control components of the airconditioning system and are not intrusive thereinto.

It is noted that all specifications hereinabove of parameters of time and temperature for the various embodiments of the cooling control systems disclosed hereinabove are approximations of the true values which may vary as a function of the equipment, the beverage to be cooled, the airconditioning system, and other factors.

In the cooling control systems described hereinabove, any suitable temperature sensors may be employed, such as the IT 5001, commercially available from Dale, El Paso, Tex. Any suitable electric valves may be employed, such as the in-line valve commercially available from Bakara, Kibbutz Geva, Israel. The coil may be formed of any suitable material, such as copper.

It will be appreciated by persons skilled in the art, that the present invention is not limited by what has been particularly shown and described above. The scope of the invention is limited, rather, solely by the claims which follow:

We claim:

1. A system for cooling fluid stored in a generally cylindrical container, said system comprising:

a generally cylindrical hollow coil element having an engaged orientation for engaging the container and a disengaged orientation in which the container is disengaged, said hollow coil element being configured to provide thermal engagement between a refrigerant fluid located interiorly thereof and said container when said hollow coil element is in said engaged orientation;

snap release actuator for selectably reorienting said generally cylindrical hollow coil element from said disengaged orientation to said engaged orientation whereby snap rotation of said coil is produced.

2. A system according to claim 1 and wherein said snap release actuator includes means for rotating at least one of the ends of said hollow coil element in a first sense during reorientation of the coil element from said disengaged orientation to said engaged orientation and in a second sense during reorientation of the coil element from said disengaged orientation to said engaged orientation.

3. A system according to claim 1 and wherein said snap release actuator comprises means for rotating the container during said reorientation of said generally cylindrical hollow coil element from said disengaged orientation to said engaged orientation.

4. A system according to claim 2 and wherein said snap release actuator comprises means for rotating the container during said reorientation of said generally cylindrical hollow coil element from said disengaged orientation to said engaged orientation.

5. A system according to claim 1 and wherein said system includes an enclosure having a selectably closable cover which surrounds said coil element and wherein said snap release actuator is operated by manual closing of said cover for reorienting of said generally cylindrical hollow coil element from said disengaged orientation to said engaged orientation.

6. A system according to claim 2 and wherein said system includes an enclosure having a selectably closable cover which surrounds said coil element and wherein said manually actuable means is operated by manual closing of said cover for reorienting of said generally cylindrical hollow coil element from said disengaged orientation to said engaged orientation.

7. A system according to claim 3 and wherein said system includes an enclosure having a selectable closable cover which surrounds said coil element and wherein said snap release actuator is operated by manual closing of said cover for reorienting of said generally cylindrical hollow coil element from said disengaged orientation to said engaged orientation.

8. A system according to claim 4 and wherein said system includes an enclosure having a selectable closable cover which surrounds said coil element and wherein said snap release actuator is operated by manual closing of said cover for reorienting of said generally cylindrical hollow coil element from said disengaged orientation to said engaged orientation.

9. A system for cooling fluid stored in a generally cylindrical container, said system comprising:

a generally cylindrical hollow coil element having an engaged orientation for engaging the container and a disengaged orientation in which the container is disengaged, said hollow coil element being configured to provide thermal engagement between a refrigerant fluid located interiorly thereof and said container when said hollow coil element is in said engaged orientation;

snap release actuator for selectably reorienting said generally cylindrical hollow coil element from said disengaged orientation to said engaged orientation and including means for rotating at least one of the ends of said hollow coil element in a first sense during reorientation of the coil element from said disengaged orientation to said engaged orientation and in a second sense during reorientation of the coil element from said disengaged orientation to said disengaged orientation.

10. A system according to claim 9 and wherein said snap release actuator comprises means for rotating the container during said reorienting of said generally cylindrical hollow coil element from said disengaged orientation to said engaged orientation.

11. A system according to claim 9 and wherein said system includes an enclosure having a selectably closable cover which surrounds said coil element and wherein said snap release actuator is operated by manual closing of said cover for reorienting of said generally cylindrical hollow coil element from said disengaged orientation to said engaged orientation.

12. A system according to claim 10 and wherein said system includes an enclosure having a selectably closable cover which surrounds said coil element and wherein said manually actuable means is operated by manual closing of said cover for reorienting of said generally cylindrical hollow foil element from said disengaged orientation to said engaged orientation.

* * * * *